United States Patent [19]

Martin

[11] Patent Number: 5,066,416

[45] Date of Patent: Nov. 19, 1991

[54] PROCESS FOR PRODUCING MOLDABLE DETERGENTS HAVING A STABLE AVAILABLE CHLORINE CONCENTRATION

[75] Inventor: Douglas R. Martin, Orange, Conn.

[73] Assignee: Olin Corporation, Cheshire, Conn.

[21] Appl. No.: 91,181

[22] Filed: Aug. 31, 1987

[51] Int. Cl.[5] ..... B08B 3/04; C11D 11/00

[52] U.S. Cl. ..... 252/90; 252/99; 252/103; 252/102; 252/135; 252/134; 252/174; 252/156

[58] Field of Search ..... 252/99, 135, 102, 90, 252/103, 93, 134, 135, 156, 174

[56] References Cited

U.S. PATENT DOCUMENTS

| | | | |
|---|---|---|---|
| Re. 32,763 | 10/1988 | Feinholtz | 252/90 |
| 4,219,435 | 8/1980 | Biard et al. | 252/90 |
| 4,219,436 | 8/1980 | Gromer et al. | 252/135 |
| 4,569,780 | 2/1986 | Fernholz et al. | 252/90 |
| 4,569,781 | 2/1986 | Fernholz et al. | 252/92 |
| 4,681,696 | 7/1987 | Bruegge et al. | 252/99 |
| 4,681,914 | 7/1987 | Olson et al. | 252/91 |
| 4,690,770 | 9/1987 | Jeschke et al. | 252/99 |

FOREIGN PATENT DOCUMENTS

| | | |
|---|---|---|
| 0003769 | 9/1979 | European Pat. Off. . |
| 0165676 | 6/1984 | European Pat. Off. . |
| 0203523 | 12/1986 | European Pat. Off. . |
| 0203526 | 12/1986 | European Pat. Off. . |

*Primary Examiner*—Josephine Barr

*Attorney, Agent, or Firm*—James B. Haglind; Paul Weinstein

[57] ABSTRACT

A moldable detergent having a stable available halogen concentration suitable for use in industrial and institutional dishwashers is produced in a process which comprises:

admixing an alkali metal polyphosphate compound, an alkali metal silicate compound, and an aqueous solution of an available halogen compound to form an available halogen containing mixture, and admixing an alkali metal phosphate compound to produce a moldable detergent composition containing at least 50 percent by weight of solids and having an available halogen concentration of at least about 1 percent by weight.

17 Claims, No Drawings

PROCESS FOR PRODUCING MOLDABLE DETERGENTS HAVING A STABLE AVAILABLE CHLORINE CONCENTRATION

This invention relates to a process for producing moldable detergents, and more particularly, the production of solid cast detergents having a stable available chlorine concentration.

Solid cast detergent compounds typically are prepared in disposable containers for use in industrial and institutional (I&I) automatic dishwashers. The detergent compound is dispensed by a liquid spray, but generally contains either no or very low concentrations of available chlorine. I&I dishwashing compounds should contain a sufficient amount of available chlorine to provide satisfactory soil and stain removal.

Prior attempts have been made to include available chlorine sources in solid cast detergent compositions. For example, U.S. Pat. Nos. 4,569,780-1, issued Feb. 11, 1986 to P. J. Fernholz et al. These patents teach solid cast detergents where an available chlorine source is contained in a separate preformed core or plug which is inserted into the body of the solid cast detergent.

European patent application No. 165,876, published Dec. 27, 1985 by A. J. Bruegge et al teach a method of stabilizing an available halogen source by mixing the available halogen source with water and one or more sulfonamide compounds. A slurry of the detergent components including the available halogen source and the sulfonamide compounds is formed and the mixture set to form a solid detergent.

Now it has been found that moldable detergents can be produced having improved available chlorine stability which provides the detergents with the desired soil and stain removal when used, for example, in institutional automatic dishwashers.

These and other advantages are accomplished in a process for producing a moldable detergent composition which comprises:

a) admixing an alkali metal polyphosphate compound, an alkali metal silicate compound, and an aqueous solution of an available halogen compound to form an available halogen containing mixture, and b) admixing an alkali metal phosphate compound to produce a moldable detergent composition containing at least 50 percent by weight of solids and having an available halogen concentration of at least about 1 percent by weight.

More in detail, the novel process of the present invention for producing moldable detergent compositions utilizes as one component an alkali metal polyphosphate compound. Alkali metal polyphosphate compounds which can be used include crystalline alkali metal polyphosphates and glassy alkali metal polyphosphates. Suitable examples include alkali metal tripolyphosphates, alkali metal tetrapolyphosphates alkali metal metaphosphates, and alkali metal pyrophosphates where the alkali metal includes sodium, potassium, and lithium. A preferred embodiment of the polyphosphate compound is an alkali metal tripolyphosphate such as sodium tripolyphosphate or potassium tripolyphosphate.

To minimize lumping and caking of the polyphosphate compound, it is preferably used as a hydrate containing small amounts of water, for example, from about 2 to about 4 percent by weight.

Amounts of alkali metal polyphosphate compound employed in the process of the present invention are at least 30 percent by weight of the moldable detergent composition, for example, from about 30 to about 50 percent by weight.

A second component of the moldable detergent composition is an alkali metal silicate such as sodium metasilicate or potassium metasilicate. Anhydrous or hydrated alkali metal silicates may be used, with anhydrous silicates being preferred.

Any suitable amounts of the alkali metal silicate compound may be used, for example, up to about 20 percent by weight, and preferably from about 10 to about 15 percent by weight.

Suitable compounds for providing the available halogen concentration are hypochlorite-generating compounds or hypobromite-generating compounds. These compounds must be water-soluble and generate an active halogen ion (i.e., $OCl^-$ or $OBr^-$) upon dissolution in water.

Sufficient amounts of the available halogen compound are incorporated in the mixture to provide an initial available halogen concentration of at least 1 percent by weight.

Preferred as available halogen compounds are hypochlorite-generating compounds. Examples of some inorganic hypochlorite-generating compounds include aqueous solutions of sodium hypochlorite and potassium hypochlorite as well as lithium hypochlorite and calcium hypochlorite, with aqueous solutions of sodium hypochlorite being preferred.

Hypochlorite-generating organic compounds include chlorinated isocyanuric acid compounds such as trichlorocyanuric acid, dichlorocyanuric acid, sodium dichloroisocyanurate and potassium dichloroisocyanurate. Additional suitable organic compounds are chloro hydantoin compounds including the monochloro- and dichloro hydantoin compounds such as 1,3-dichloro-5,5-dimethylhydantoin, 1-monochloro-5,5-dimethylhydantoin, methylene-bis(1-chloro-5,5-dimethylhydantoin), 1,3-dichloro-5-methyl-5-isobutylhydantoin, 1,3-dichloro-5-methyl-5 n-amylhydantoin, chloro bromo hydantoin, and the like.

The water present in the aqueous solution of the available chlorine compound may satisfy or at least partially satisfy that required in the hydration of the polyphosphate and silicate compounds.

Added to the available halogen containing mixture as detergent builders are alkali metal phosphates. Alkali metal phosphates which can be included in the novel process of the present invention include monosodium phosphate, disodium phosphate, trisodium phosphate, monopotassium phosphate, dipotassium phosphate, and tripotassium phosphate as the anhydrous compound or hydrates containing up to 12 moles of water of hydration.

Particle sizes of the alkali metal phosphate are selected to provide the detergent mixtures with particles at least 50 percent of which are smaller than about 150 microns (100 mesh). Preferably at least 70 to 100 percent of the alkali metal phosphate are smaller than about 150 microns.

The components are blended to provide the detergent mixture with at least 50% by weight of solids, and preferably from about 60 to about 70% by weight of solids.

As the addition of nearly all of the components to the mixture results in an exothermic reaction, sufficient mixing time is allowed between the addition of components to allow the mixture to come to equilibrium.

To produce moldable detergent compositions having suitable hardening or setting times, it is preferred to add the hydratable components in an order based on this rate of hydration, with the polyphosphates having the slowest rates of hydration being added first and the alkali metal phosphates having the fastest rates of hydration being added last.

Where the available halogen compound is particularly susceptible to decomposition, for example, by hydrolysis, a portion or all of the available halogen compound may be added to the mixture following the addition of the alkali metal phosphate.

The resultant moldable detergent slurry produced has a temperature between about 50° and about 70° C. The detergent slurry is then poured quickly into a suitable mold or form and allowed to solidify. Suitable hardening times are those of at least 1 hour, for example from about 1 to about 6 hours, and preferably from about 1.5 to about 3 hours. The solid cast detergents produced have hardnesses which are suitable for use in industrial and institutional dishwashers. For example, after 24 hours, the solid cast detergents have a hardness of at least 100 psi.

The moldable detergents produced by the process of the present invention have an initial available halogen concentration of at least about one percent by weight. As the stability of the detergent is excellent, the halogen concentration of the solid cast detergent after several months is at least 50% of the initial concentration.

Other chemicals which may be included in the moldable detergent mixture include surfactants which are compatible with the mixture.

to the slurry and the mixing continued until a maximum temperature was reached. Anhydrous sodium metasilicate was then added to the available chlorine containing slurry and the mixing continued until a maximum temperature was reached. Upon the addition of powdered anhydrous trisodium phosphate, the mixing was continued until a maximum temperature was reached. The detergent slurry, at a temperature in the range of 50°-70° C., was poured rapidly into a plastic mold and allowed to harden. The hardening time was determined by probing a sample with a stirring rod and after 24 hrs, the hardness of the solid cast detergent was measured using a Rimac spring tester. The initial available chlorine concentration of the solid cast detergent was determined. The solid cast detergents were stored at ambient temperature and humidity for a period of 4 or 5 months and the available chlorine concentration redetermined. The weight percent of each component, the hardening time, hardness value and available chlorine concentration are given in Table I.

EXAMPLE 5

The process of Examples 1-4 was repeated identically with the exception that 1% by weight of a surfactant, sodium dodecyl diphenyloxide disulfonate (Dowfax 2Al) was added to the mixture. The results are given in Table 1.

EXAMPLE 6

The process of EXAMPLES 1-4 was repeated identically with the exception that 4% sodium dichloroisocyanurate dihydrate (CDB CLEARON®) was added as a solid after the trisodium phosphate had been admixed. The results are given in Table 1.

TABLE I

| | SOLID CAST DETERGENTS | | | | | |
|---|---|---|---|---|---|---|
| Component | Example 1 | Example 2 | Example 3 | Example 4 | Example 5 | Example 6 |
| Sodium Tripolyphosphate | 35.0 | 30.0 | 34.0 | 35.0 | 35.0 | 35.0 |
| Water | 25.0 | 25.0 | 26.0 | 20.0 | 24.0 | 31.0 |
| Sodium Hypochlorite (10%) | 15.0 | 20.0 | 15.0 | 15.0 | 15.0 | 0.0 |
| Sodium Metasilicate, Anhydrous | 10.0 | 10.0 | 10.0 | 10.0 | 10.0 | 15.0 |
| Trisodium Phosphate, Anhydrous | 15.0 | 15.0 | 15.0 | 20.0 | 15.0 | 15.0 |
| Sodium dichlorisocyanurate dehydrate | | | | | | 4.00 |
| Sodium dodecyl diphenyloxide disulfonate | | | | | 1.00 | |
| Available chlorine, Initial | 1.38 | 1.72 | 1.59 | 1.33 | 0.98 | 1.12 |
| % of Initial Available Cl after 4 mos | — | 63.0 | 50.0 | 50.0 | 57.0 | — |
| % of Initial Available Cl after 5 mos | 55.0 | — | — | | — | 76.0 |
| Hardening time, (Hrs) | 2.00 | 1.50 | 2.00 | 1.00 | 1.70 | 1.0 |
| Hardness after 24 hrs (psi) | 250.0 | 350.0 | 350.0 | 125.0 | 350.0 | 175.0 |
| pH of 1% soln. | 11.77 | 11.58 | 11.55 | 11.75 | 11.55 | 11.70 |

The moldable detergents produced by the process of the present invention are suitably alkaline however if desired, other alkaline compounds such as alkali metal carbonates may be included.

To further illustrate the novel process of the present invention, the following examples are presented without any intention of being limited thereby. All parts and percentages are by weight unless otherwise indicated.

EXAMPLES 1-4

Anhydrous sodium tripolyphosphate was fed to a fluidized bed (Aeromatic) and hydrated with water to a moisture content of 2-4 percent. Water was added to the hydrated sodium tripolyphosphate and continuously admixed to produce a tripolyphosphate slurry. A sodium hypochlorite solution (10% NaOCl) was added

What is claimed is:

1. A process for producing a moldable detergent which comprises:

a) preparing an aqueous slurry containing an alkali metal polyphosphate compound, an alkali metal silicate compound, and an available halogen compound, b) admixing with the aqueous slurry an alkali metal phosphate compound to produce a moldable detergent composition, the proportions of the components of steps a) and b) being such that the moldable detergent composition contains at least 50 percent by weight of solids and has an available halogen concentration of at least about 1 percent by weight.

2. The process of claim 1 in which the available halogen compound is a hypochlorite-generating compound or a hypobromite-generating compound.

3. The process of claim 1 in which at least about 50 percent of the alkali metal phosphate compound has a particle size smaller than about 150 microns.

4. The process of claim 1 in which the alkali metal polyphosphate compound is initially mixed with an aqueous solution of the available halogen compound.

5. The process of claim 1 in which the alkali metal polyphosphate compound is selected from the group consisting of alkali metal tripolyphosphates, alkali metal tetrapolyphosphates, alkali metal metaphosphates, and alkali metal pyrophosphates.

6. The process of claim 5 in which the alkali metal polyphosphate compound has a water concentration of from about 2 to about 4 percent by weight.

7. The process of claim 2 in which the available halogen compound is a hypochlorite-generating compound selected from the group consisting of chlorinated isocyanuric acid compounds, chloro hydantoin compounds and inorganic hypochlorites.

8. The process of claim 7 in which the available halogen compound is an inorganic hypochlorite.

9. The process of claim 8 in which from about 70 to about 100 percent of the particles of the alkali metal phosphate are smaller than about 150 microns.

10. The process of claim 9 in which the inorganic hypochlorite is sodium hypochlorite.

11. The process of claim 10 in which the alkali metal phosphate compound comprises at least about 30 percent by weight of the moldable detergent composition.

12. The process of claim 3 in which the alkali metal polyphosphate compound is an alkali metal tripolyphosphate.

13. The process of claim 12 in which the available halogen compound is an inorganic hypochlorite.

14. The process of claim 13 in which the alkali metal silicate is anhydrous sodium metasilicate.

15. The process of claim 14 in which the alkali metal polyphosphate compound is sodium tripolyphosphate.

16. A process for producing a solid molded detergent which comprises:

a) preparing an aqueous slurry containing an alkali metal polyphosphate compound, an alkali metal silicate compound, and an available halogen compound, b) admixing with the aqueous slurry an alkali metal phosphate compound to produce a moldable detergent composition, and c) pouring the moldable detergent composition into a mold and allowing the composition to harden, the proportions of the components being such that the molded detergent composition contains at least 50 percent by weight of solids and has an available halogen concentration of at least about 1 percent by weight.

17. The process of claim 16 in which the hardening time is from about 1 to about 6 hours.

* * * * *